US006866537B2

(12) United States Patent
Yuasa et al.

(10) Patent No.: US 6,866,537 B2
(45) Date of Patent: Mar. 15, 2005

(54) ELECTRICAL CABLE AND CONNECTION STRUCTURE BETWEEN ELECTRICAL CABLE AND TERMINAL

(75) Inventors: Eriko Yuasa, Mie (JP); Shuji Yamakawa, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/649,038

(22) Filed: Aug. 27, 2003

(65) Prior Publication Data

US 2004/0067678 A1 Apr. 8, 2004

(30) Foreign Application Priority Data

Sep. 4, 2002 (JP) ..... 2002-259189

(51) Int. Cl.[7] ..... H01R 4/24
(52) U.S. Cl. ..... 439/395
(58) Field of Search ..... 439/395, 76.2; 174/102 C

(56) References Cited

U.S. PATENT DOCUMENTS 5,898,133 A * 4/1999 Bleich et al. ..... 174/121 A
2002/0173196 A1 * 11/2002 Enomoto et al. ..... 439/422

FOREIGN PATENT DOCUMENTS

JP 2002-208317 7/2002

* cited by examiner

*Primary Examiner*—Renee Luebke
(74) *Attorney, Agent, or Firm*—Harness, Dickey & Pierce, P.L.C.

(57) ABSTRACT

An electrical cable is used to form an internal circuit in an electrical connection box to be mounted on an automobile. An aluminum-based metal conductor is covered with a heat-resistant resin, such as PE (polyethylene) or PBT (polybutylene terephthalate). The conductor is a single core wire or a twisted core wire, which has a plurality of element wires. The conductor is pushed into an insulation displacement slot in an insulation displacement terminal. The insulation displacement terminal is made from an aluminum-based metal or a copper-based metal. A welding material, made of an iron-based metal, welds a contact portion between the conductor and a blade section on an inner peripheral edge of the insulation displacement slot.

2 Claims, 4 Drawing Sheets

ELECTRICAL CABLE AND CONNECTION STRUCTURE BETWEEN ELECTRICAL CABLE AND TERMINAL

CROSS-REFERENCE TO RELATED APPLICATIONS

This application claims priority to Japanese Patent Application No. 2002-259189, filed Sep. 4, 2002, which application is herein expressly incorporated by reference.

FIELD OF THE INVENTION

This invention relates to an electrical cable and a connection structure between the electrical cable and a terminal. More particularly, the invention improves electrical cable used to form an internal circuit in an electrical connection box, such as a junction box, mounted on an automobile, in view of its recyclability upon junking an automobile.

BACKGROUND OF THE INVENTION

A number of electrical cables are arranged in an automobile. The electrical cables are also arranged in the electrical connection box, such as a junction box, to form an internal circuit.

For convenience of explanation, a conventional electrical cable and a connection structure between the conventional electrical cable and a terminal will be described by referring to FIG. 6. FIG. 6 is a perspective view of a conventional connection structure between an electrical cable and a terminal.

As shown in FIG. 6, an electrical cable 1 generally includes a twisted core wire 2. The core wire 2 is formed by twisting a number of element wires made of soft copper. An insulation sheath 3, made of vinyl chloride, covers the twisted core wire 2.

In the case where the above electrical cable 1 is arranged in the electrical connection box to form an internal circuit, the electrical cable is pushed into an insulation displacement slot 4*a* in an insulation displacement terminal 4 in an insulation displacement manner to form a branched connection circuit. The insulation displacement terminal 4 is produced by punching a copper-based metal plate. The internal circuit in the electrical connection box uses a bus bar. The bus bar is produced by punching a copper-based metal plate into a circuit configuration.

Recent, requirements make it desirable to enhance recyclability of junked automobiles. Iron accounts for the largest percentage of an automobile. When the junked automobile is thrown into an incinerator to recover and recycle the iron, the required mixing rate of copper to iron should be less than 0.1%. This prevents the iron from becoming denatured due to a reaction with the copper.

Since the electrical cable 1 is made of soft copper wires, as described above, it is preferable to remove the electrical cable 1 from the car body upon disassembly of the automobile and to separate the electrical cable 1 from the iron-based car body. A wire harness including a group of electrical cables arranged along the car body can easily be separated from the car body. However, the electrical connection box must be disassembled in order to remove the electrical cable from the electrical connection box. This requires extensive manpower and is not practical.

In the case where the internal circuit in the electrical connection box is formed by bus bars made of a copper-based metal plate, the bus bars must be removed from the electrical connection box. This also requires extensive manpower and is not practical.

The insulation sheath 3 of the electrical cable 1 is made of vinyl chloride. Recently, environmental requirements dictate lower utilization of vinyl chloride, which has a chlorine component, in order to suppress halogenation.

In view of the above problems in recycling and in the environment, it is an object of the present invention to improve the material of an electrical cable. The improvement overcomes the problems caused by insulation displacement connections between the improved electrical cable and an insulation displacement terminal.

SUMMARY OF THE INVENTION

In order to overcome the above problems, an electrical cable is used to form an internal circuit in an electrical connection box to be mounted on an automobile. The electrical cable includes a conductor made of an aluminum-based metal covered with a heat-resistant resin, such as PE (polyethylene) or PBT (polybutylene terephthalate). The conductor is a single core wire or a twisted wire having a plurality of element wires.

By substituting the aluminum based conductor for the conventional soft copper conductor, the present invention reduces the mixing rate of copper to iron. The reduced mixing rate overcomes problems associated with the recovery of iron during vehicle recycling and enhances the recyclability of junked automobiles.

Also, since the insulation sheath is made of the PE or PBT, lacking a chlorine component, the present invention overcomes an environmental problem due to halogenation. Since the PE or PBT has a heat-resistant nature, it is suitable for a sheath material for a conductor made of aluminum-based metal.

In the case where the electrical cable is arranged in the electrical connection box to form the internal circuit and pressed onto the insulation displacement terminal in the insulation displacement manner, the outer surface of the conductor is shaved slightly by the inner peripheral edges of the insulation displacement slot in the insulation displacement terminal. This obtains a firm electrical connection.

Since conventional insulation displacement terminals are made of a copper-based metal plate, the opposite side edges of the insulation displacement slot have an elastic function. The opposite side edges are inwardly deformed by the shaved amount of the conductor. The spring force exerted in the opposite side edges has applied a desired fitting force to the insulation displacement terminal and conductor.

However, in the case where the insulation displacement terminal is made of aluminum-based metal plate, the aluminum-based metal plate is non-elastic. Even if the conductor is shaved slightly upon connection, the insulation displacement terminal does not move to follow the shaved conductor. Consequently, there is a problem that a desired fitting force cannot be obtained and reliability of the electrical connection is lowered.

In order to overcome the above problem, the present invention is directed to a connection structure between an electrical cable and a terminal. The connection structure has an aluminum-based metal conductor arranged to form an internal circuit in an electrical connection box to be mounted on an automobile. The conductor is pushed into an insulation displacement slot in an insulation displacement terminal made of an aluminum-based metal or a copper-based metal. A welding material, made of an iron-based metal, welds a contact portion between the conductor and a blade section on an inner periphery of the insulation displacement slot.

In the above construction, the conductor and insulation displacement terminal are made of aluminum-based metal. The welding material is made of iron-based metal. The welding material welds the press contact connection portion between the shaved conductor and the insulation displacement terminal to compensate for the reduced diameter of the conductor. This construction solves problems that the fitting force of the terminal and reliability in electrical connection are lowered on account of a lack of an elastic function of the terminal. Since the welding material is made of the iron-based metal, it does not increase the mixing rate of copper to iron during recycling.

Thus, the electrical connection portion welded by the iron based welding material forms the conductor and insulation displacement terminal by substituting the aluminum-based metal for the conventional copper-based metal. Thus, it is possible to reduce the mixing rate of copper to iron which causes problems upon recovery of iron during recycling of car bodies and enhances the recyclability of junked automobiles.

Since the above electrical cable is arranged in the electrical connection box, the electrical cable may be an electrical cable with no insulation sheath (so-called naked cable). It is preferable that both the naked cable and the sheathed cable include a single thick core wire in order to connect the cable to the insulation displacement terminal. However, the conductor is not limited to the single core wire. The conductor may be a twisted core wire covered with an insulation sheath. In the case where the insulation-sheathed electrical cable is used, the blades on the inner peripheral edges of the insulation displacement slot cut the insulation sheath to come into contact with the conductor. In this case, the press contact portion between the conductor and the insulation displacement terminal is welded.

Instead of using the above welding material, a conductive adhesive may be filled in and applied on a contact portion between the conductor and a blade section on an inner periphery of the insulation displacement slot.

BRIEF DESCRIPTION OF THE DRAWINGS

The foregoing and other features of the present invention will become apparent to one skilled in the art to which the present invention relates upon consideration of the invention with reference to the accompanying drawings, wherein.

DETAILED DESCRIPTION OF THE PREFERRED EMBODIMENTS

Figure 1A:
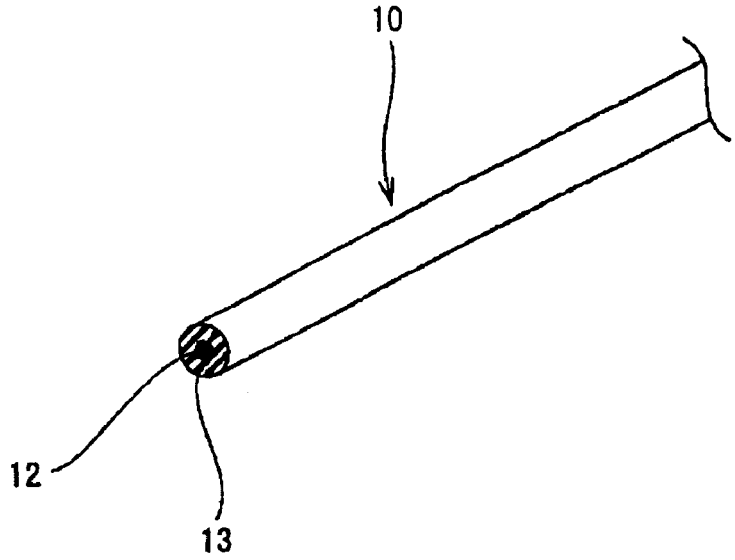
FIGS. 1A, 1B, and 1C are perspective views of electrical cables in accordance with the present invention.

In describing the preferred embodiment of the present invention, reference will be made herein to FIGS. 1 to 5 of the drawings in which like numerals refer to like features of the invention. Features of the invention are not necessarily shown to scale in the drawings.

Embodiments of an electrical cable and a connection structure between the electrical cable and a terminal in accordance with the present invention will be described below by referring to the drawings.

FIG. 1A shows an electrical cable 10 in accordance with the present invention.

Figure 1B:
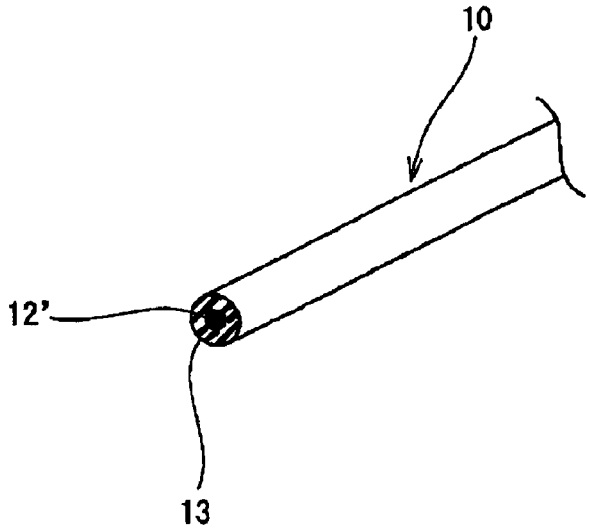
Figure 1C:
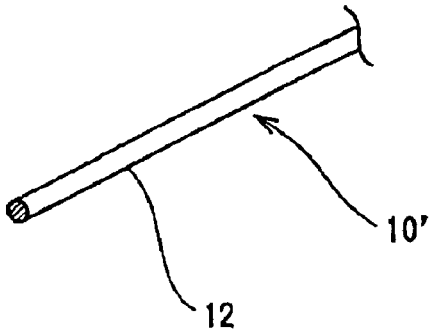

The electrical cable 10 includes a single core wire or a conductor 12 made of an aluminum-based metal and an insulation sheath layer 13 made of a PE (or PBT) having a heat resistant nature covering the conductor 12. As shown in FIG. 1B, a conductor 12' may be a twisted core wire formed by twisting a number of fine element wires. Furthermore, the electrical cable may be a so-called naked cable 10' in which the conductor 12 is not covered by the insulation sheath layer 13, as shown in FIG. 1C. Here the electrical cable is arranged in a place that requires no insulation function.

Although the conductor 12, made of an aluminum-based metal, is formed from pure aluminum in this embodiment, the conductor may be made of not only pure aluminum but also an aluminum alloy, such as Al—Mg, Al—Mn, Al—Mg—Si, Al—Zn—Mg, or Al—Si. A conductivity of pure aluminum is 60% of that of copper while a conductivity of an aluminum alloy is 30% of copper. It will be preferable to use pure aluminum from a conductivity viewpoint.

The electrical cable 10 in which the conductor 12 is covered by the insulation sheath layer 13 is arranged generally in an electrical connection box such as a junction box. The electrical cable is coupled to an insulation displacement terminal in an insulation displacement manner to form a branched connection circuit.

Figure 2:
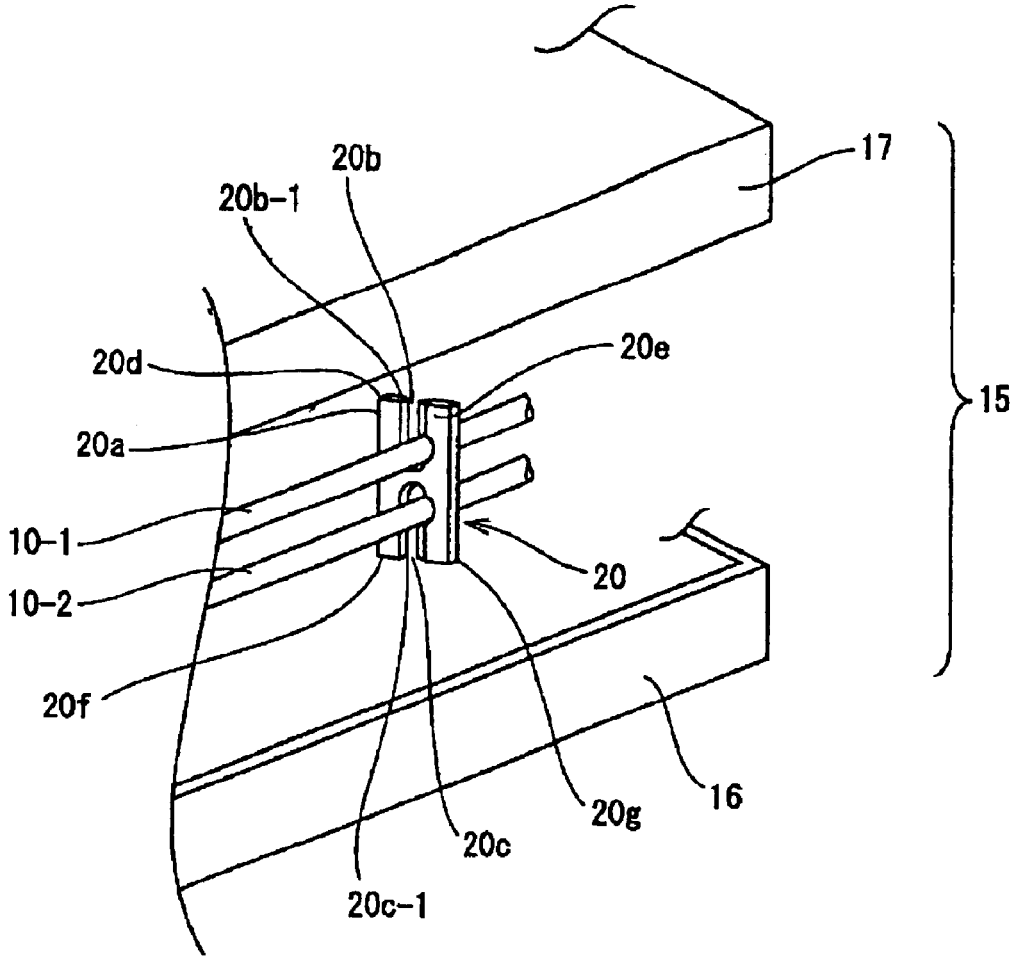
FIG. 2 is an exploded perspective view of an electrical connection box to which the present invention is applied.

As shown in FIG. 2, a junction box 15 includes a casing with a lower casing member 16 and an upper casing member 17. The electrical cable 10 is arranged in an interior of the junction box 15. An insulation displacement terminal 20, formed by punching an aluminum-based metal plate, is coupled to the electrical cable 10 in an insulation displacement manner. Although the insulation displacement terminal 20 is made of pure aluminum, it may be made of an aluminum alloy.

The insulation displacement terminal 20 is provided in upper and lower ends of a vertical plate section with U-shaped insulation displacement slots 20*b* and 20*c*. Inner peripheral edges of the insulation displacement slots 20*b* and 20*c* are formed into acute angle blades 20*b*-1 and 20*c*-1.

Opposite sides 20*d* and 20*e* of the insulation displacement slot 20*b* and opposite sides 20*f* and 20*g* of the insulation displacement slot 20*c* have no elastic functions. This is due to the fact that the insulation displacement terminal 20 is made of an aluminum-based metal plate.

Figure 3:
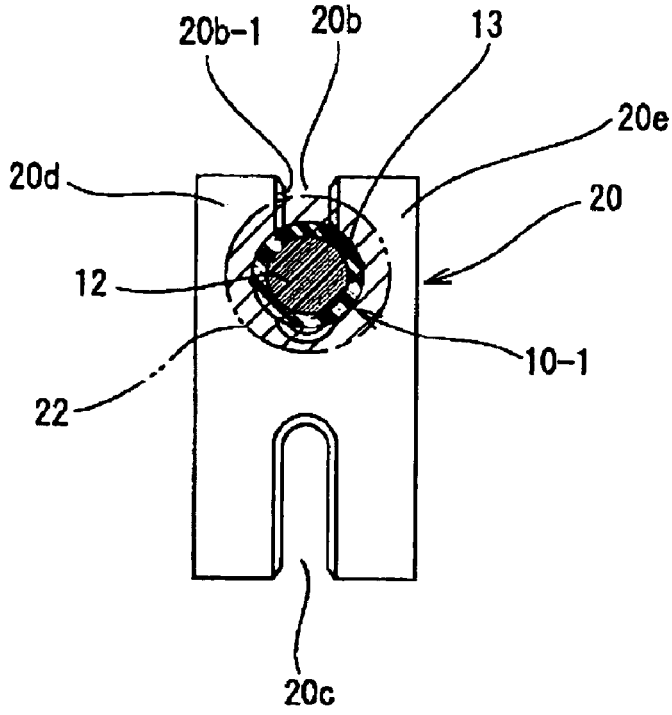
FIG. 3 is a cross sectional view of a connection structure between an electrical cable and a terminal in accordance with the present invention.

Different electrical cables 10-1 and 10-2 are pushed into the insulation displacement slots 20*b* and 20*c* of the insulation displacement terminal 20 in an insulation displacement manner to interconnect the electrical cables electrically. The electrical cable 10-1 is pushed into the insulation displacement slot 20*b*. In order to electrically couple the conductor 12 to the insulation displacement terminal 20, as shown in FIG. 3, the blade 20*b*-1 on the inner peripheral edge of the slot 20*b* must cut the insulation sheath layer 13. This cut shaves an outer surface of the conductor 12 to bring the blade 20*b*-1 into contact with an outer surface of the conductor 12.

The outer diameter of the conductor 12 is reduced at the insulation displacement position by a shaved amount.

Accordingly, a desired fitting force cannot be obtained, since the opposite conductor clamping sides 20*d* and 20*e* do not have an elastic function.

Accordingly, a welding material 22, made of an iron-based metal, welds a press contact portion between the conductor 12 and the blade 20*b*-1. In other words, the welding material 22, made of the iron-based metal, compensates for the shaved amount of the conductor 12 and serves to firmly join the conductor 12 and insulation displacement terminal 20 to each other. Similar principles can be applied to an insulation displacement portion between the electrical cable 10-2 and the insulation displacement slot 20*c*.

As described above, in the case where both the insulation displacement terminal 20 and conductor 12 are made of the aluminum-based metal and are pressed to each other, a problem exists where the insulation displacement terminal 20 cannot exert a regular fitting force onto the conductor 12. However, the welding overcomes this problem. Consequently, it is possible to firmly hold the electrical connection between the electrical cables 10-1 and 10-2 and the insulation displacement terminal 20. This enhances the reliability of the electrical connection.

Figure 4:
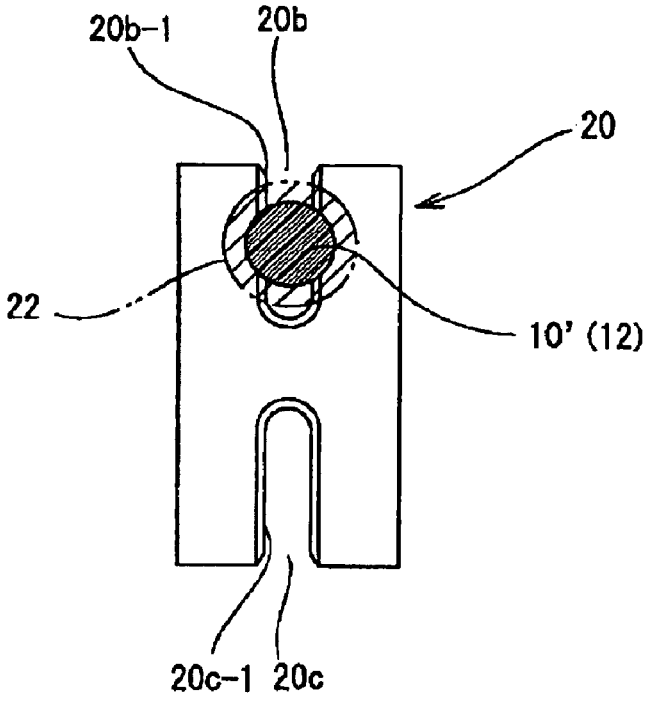
FIG. 4 is a cross sectional view of another connection structure between an electrical cable and a terminal in accordance with the present invention.

FIG. 4 shows another embodiment. A naked electrical cable 10' is used in the present embodiment. The naked electrical cable 10' does not include an insulation sheath. The naked electrical cable 10' includes a conductor 12 with a single core wire, as shown in FIG. 1C. The naked electrical cable 10' is arranged in a junction box to form an internal circuit and is pressed onto the insulation displacement terminal 20.

In the press contact connection portion between the naked electrical cable 10' and the insulation displacement terminal 20, an outer surface of the conductor 12 is shaved by the blade 20*b*-1 (20*c*-1) of the insulation displacement slot 20*b* (20*c*). Accordingly, the welding material 22, made of the iron-based metal, welds the press contact connection portion in the same manner as that in the first embodiment.

Figure 5:
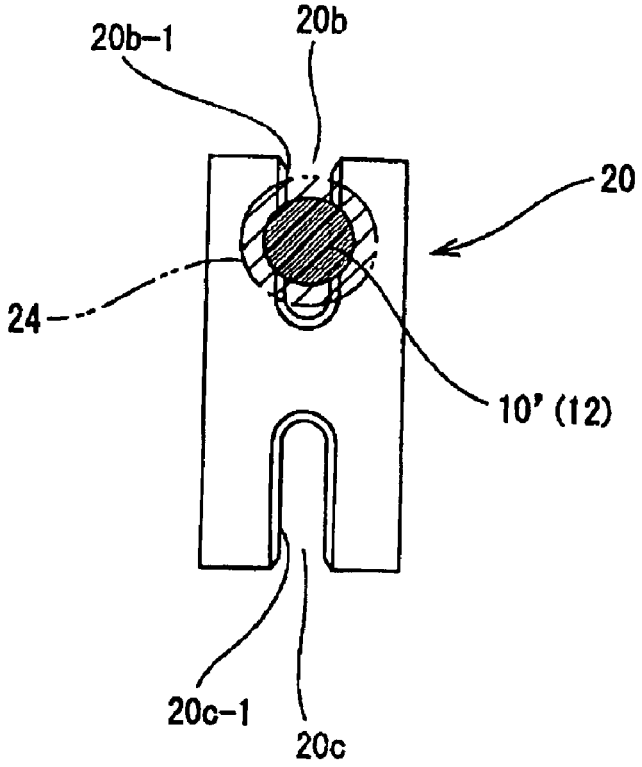
FIG. 5 is a cross sectional view of still another connection structure between an electrical cable and a terminal in accordance with the present invention.
Figure 6:
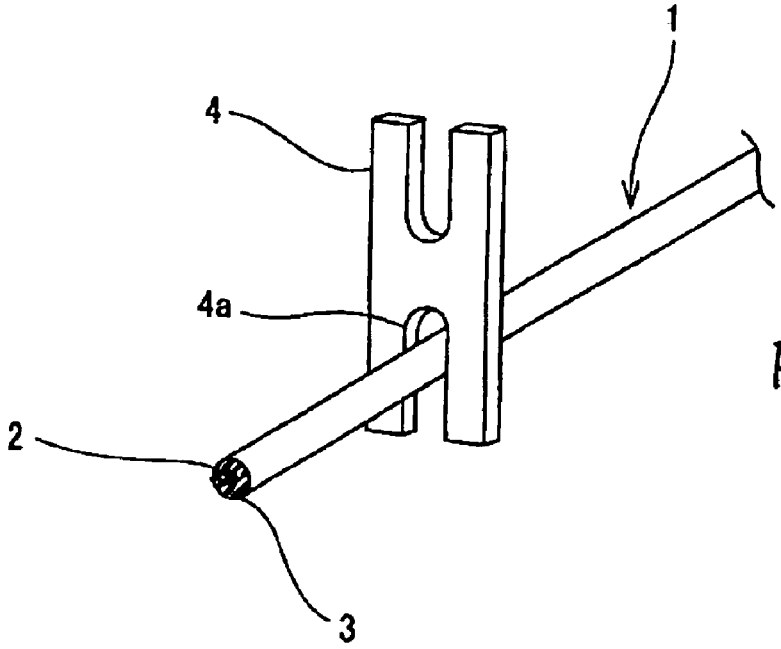
PRIOR ART Fig. 6
FIG. 6 is a perspective view of a conventional connection structure between an electrical cable and a terminal.

FIG. 5 shows still another embodiment. The naked electrical cable 10' having only the conductor 12 is used in the present embodiment similar to the embodiment shown in FIG. 4. The naked electrical cable 10' is pressed onto the insulation displacement terminal 20. A conductive resin adhesive 24 instead of the welding material 22, made of the iron-based metal, is applied on the press contact connection portion. The conductive resin adhesive 24 compensates for the shaved portion of the conductor 12.

The electrical cables are pushed into the upper and lower insulation displacement slots in the insulation displacement terminal in the above embodiments. However, the electrical cable may be pushed into the lower insulation displacement slot in the insulation displacement manner. A tab-like terminal, such as a fuse tab or a relay tab, attached to a containing section provided on the upper casing member may be pushed into the upper insulation displacement slot. In this case, it is possible to connect a conductor of an electrical cable made of an aluminum-based metal to a fuse or a relay. It is also possible to connect the electrical cable to a male terminal in a connector to be connected to an external electrical cable. This connects the electrical cable of the internal circuit in the electrical connection box to the external electrical cable through the insulation displacement terminal. The insulation displacement terminal may have one end with an insulation displacement slot and the other end with a tab.

While the present invention has been particularly described, in conjunction with a specific preferred embodiment, it is evident that many alternatives, modifications, and variations will be apparent to those skilled in the art in light of the foregoing description. It is therefore contemplated that the appended claims will embrace any such alternatives, modifications, and variations as falling within the true scope and spirit of the present invention.

What is claimed is:

1. A connection structure between an electrical cable and a terminal comprising:

a conductor made of an aluminum-based metal arranged to form an internal circuit in an electrical connection box to be mounted on an automobile;

said conductor is pushed into an insulation displacement slot in an insulation displacement terminal made of an aluminum-based metal or a copper-based metal; and a welding material made of an iron-based metal welds a contact portion between said conductor and a blade section on an inner periphery of said insulation displacement slot.

2. A connection structure between an electrical cable and a terminal comprising:

a conductor made of an aluminum-based metal arranged to form an internal circuit in an electrical connection box to be mounted on an automobile;

said conductor is pushed into an insulation displacement slot in an insulation displacement terminal made of an aluminum-based metal or a copper-based metal; and a conductive adhesive is filled in and applied on a contact portion between said conductor and a blade section on an inner periphery of said insulation displacement slot.

* * * * *